United States Patent [19]

Medel, Jr. et al.

[11] 4,391,574

[45] Jul. 5, 1983

[54] ROTARY POSITIVE DISPLACEMENT MECHANISM

[75] Inventors: Louis W. Medel, Jr., Sylmar; Yoram Barak, Woodland Hills, both of Calif.

[73] Assignee: Helen H. Noga, Los Angeles, Calif. ; a part interest

[21] Appl. No.: 130,191

[22] Filed: Mar. 13, 1980

[51] Int. Cl.[3] ..... F01C 3/02

[52] U.S. Cl. ..... 418/195; 418/207

[58] Field of Search ..... 418/195, 207; 123/221

[56] References Cited

U.S. PATENT DOCUMENTS 1,013,121 1/1912 Brooks ..... 418/207

*Primary Examiner*—John J. Vrablik

*Attorney, Agent, or Firm*—Lyon & Lyon

[57] ABSTRACT

A device having a power rotor and a seal rotor which have coincident center points. The power rotor rotates in a plane which is perpendicular to that within which the seal rotor rotates. The power rotor has a rotor body to which are attached a plurality of outwardly extending vanes. The seal rotor has a rim gear to which are attached a plurality of inwardly extending vanes. The power rotor vanes and the seal rotor vanes interdigitate upon rotation of the rotors to define two variable volume chambers. The power rotor vanes and the seal rotor vanes are designed and constructed to insure a close mesh during such interdigitation and means are provided for adjusting the position of the power rotor vanes relative to the seal rotor vanes to insure proper interdigitation.

6 Claims, 8 Drawing Figures

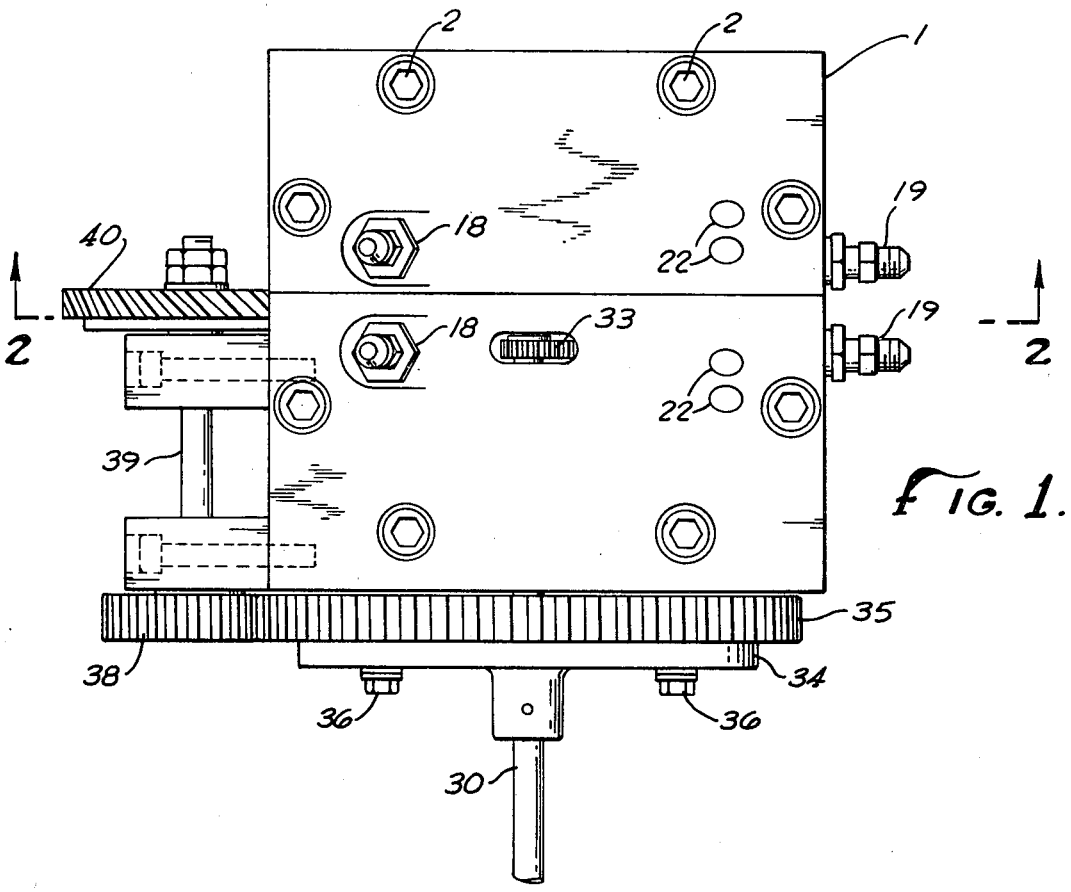
FIG. 1.
FIG. 2.
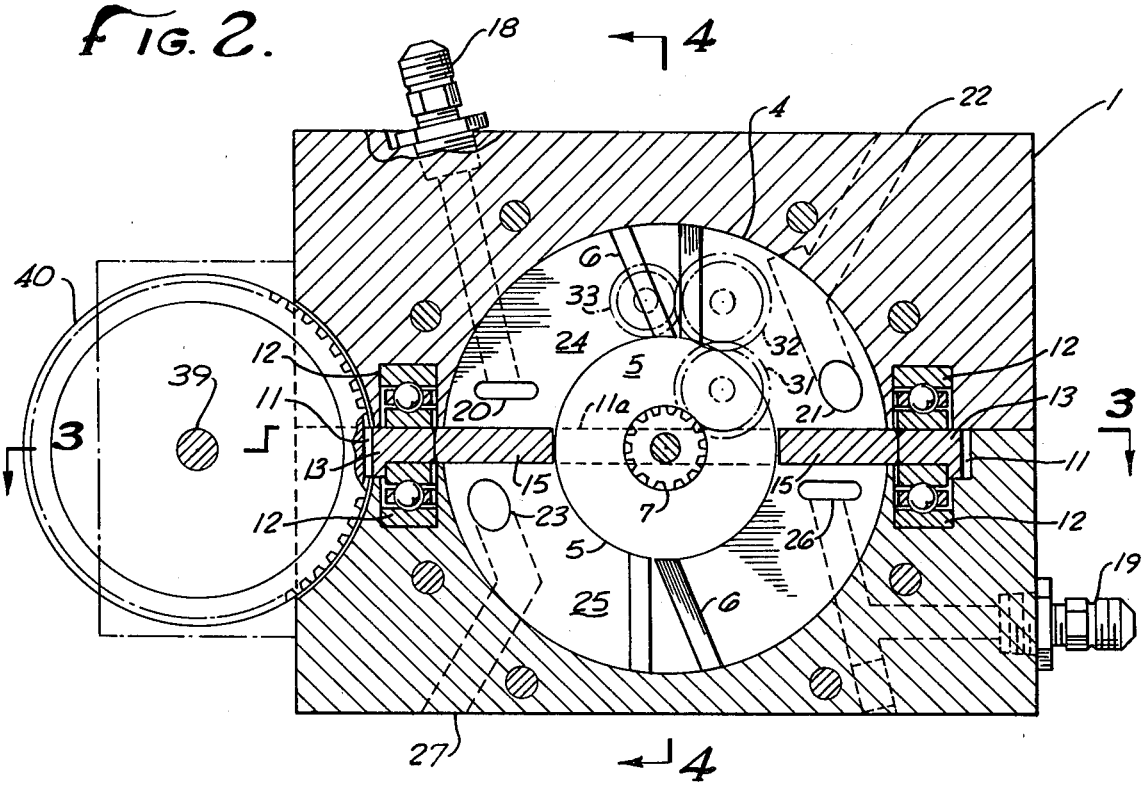

ROTARY POSITIVE DISPLACEMENT MECHANISM

BACKGROUND OF INVENTION

The present invention relates to motors and pumps. More particularly, it relates to positive displacement rotary-type motors and pumps, specifically those rotary motors which are driven by pressurized fluid.

Due to the drawbacks inherent in the linear, oscillating motion and internal combustion of conventional piston engines, considerable attention has been directed to the development of alternative engine and motor designs. To circumvent the oscillating, linear motion of the conventional piston engine, many engine and motor designs have incorporated rotary motion of the power producing element. Turbine and rotary engines utilize this principle. Those rotary and turbine engines which have utilized internal combustion have suffered from low efficiency, limited durability and inflated expense and still produce the dirty exhaust of the conventional piston engines. Those rotary and turbine designs which have utilized external combustion have proven too inefficient to be of widespread practical utility.

SUMMARY OF INVENTION

The present invention is directed to a device employing two rotors designed such that they rotate about intersecting axes and have coincident center points. These rotors are contained within intersecting chambers such that one rotor thereby provides a displacement function while the other provides a sealing function. The chambers and rotors cooperate to define two variable volume chambers which may be employed as either pumping chambers or fluid motor power chambers. In this way, a positive displacement mechanism has been developed which employs balanced rotation. This efficient system lends itself to use as a source of motive power derived from the use of pressurized fluids, pressurized by external combustion or other means.

To accomplish positive displacement with pure rotary motion, the power rotor is positioned within the seal rotor, with both rotors rotatable about the same center point. The power rotor, however, rotates in a plane perpendicular to that in which the seal rotor rotates. The power rotor comprises a rotor body which has a plurality of outwardly extending vanes, which vanes interdigitate during rotation with a similar number of vanes extending inwardly from the seal rotor, said seal rotor having a rim gear to which the inwardly extending vanes are attached. The vanes on each rotor are designed and constructed to mesh closely during such interdigitation. This interdigitation allows the seal rotor vanes to eliminate fluid backpressure against the trailing power rotor vane and makes possible the positive displacement of the power rotor through its rotary motion. Also provided in the motor are fluid inlet and outlet means, rotor timing and adjustment means and power transmission means.

DESCRIPTION OF FIGURES

FIG. 1 is a top view of the motor of the present invention enclosed within the housing block.

FIG. 2 is a side view of the invention, taken in cross-section along line 2—2 in FIG. 1, showing the positional relationship of the power rotor and the seal rotor.

DETAILED DESCRIPTION OF PREFERRED EMBODIMENT

The positive displacement device of the present invention is encased in a substantially solid, square housing block 1, which in the preferred embodiment has been formed in four pieces for ease of assemblage. The four pieces of the housing block are held together by conventional nut and bolt means 2.

Figure 5:
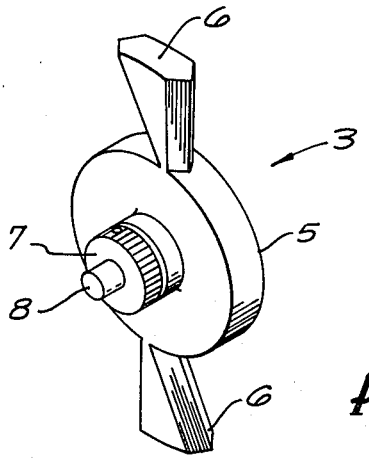
FIG. 5 is a perspective view of the power rotor in isolation.

Turning to the interior of the device, as shown in FIG. 2, power rotor 3 is rotatably journaled within a first cylindrical chamber 4. Power rotor 3 is best seen in FIG. 5. Power rotor 3 has rotor body 5 which is circular and solid. Power rotor vanes 6 extend outwardly from the rotor body 5. The vanes 6 are substantially triangular in shape and are attached to the rotor body 5 at the apex of that triangle. The leading and trailing edge of the vanes 6 are provided with a knife edge. Also attached to the rotor body 5 is spur gear 7. The function of spur gear 7 is explained infra. Extending through the center and protruding either side of power rotor 3 and spur gear 7 is axle 8 used to rotatably journal power rotor 3 within first chamber 4 by conventional journal means 9, as best seen in FIG. 3.

Figure 3:
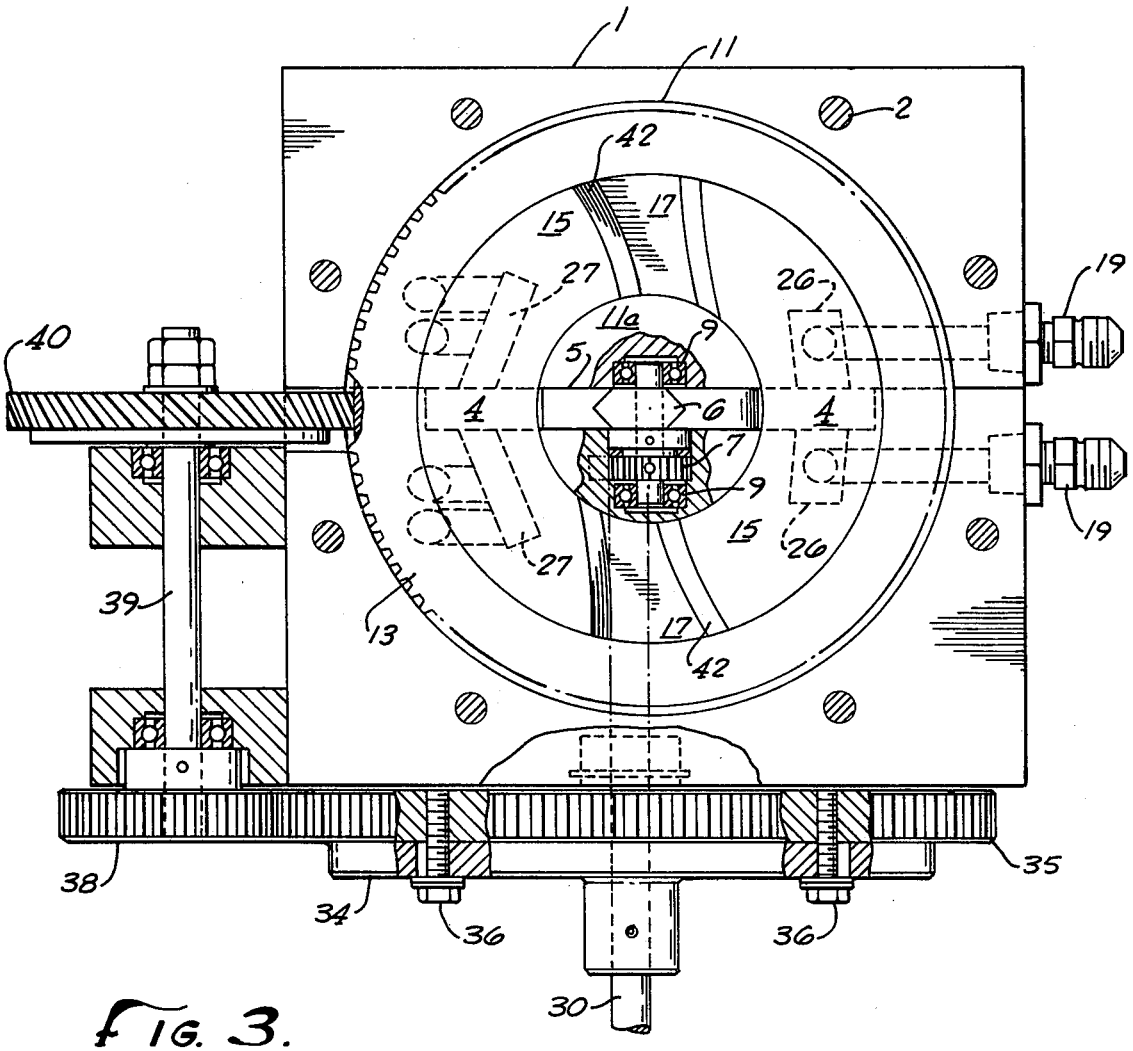
FIG. 3 is a bottom view of the invention, taken in cross-section along line 3—3 of FIG. 2, showing the positional relationship of the power rotor and the seal rotor.
Figure 4:
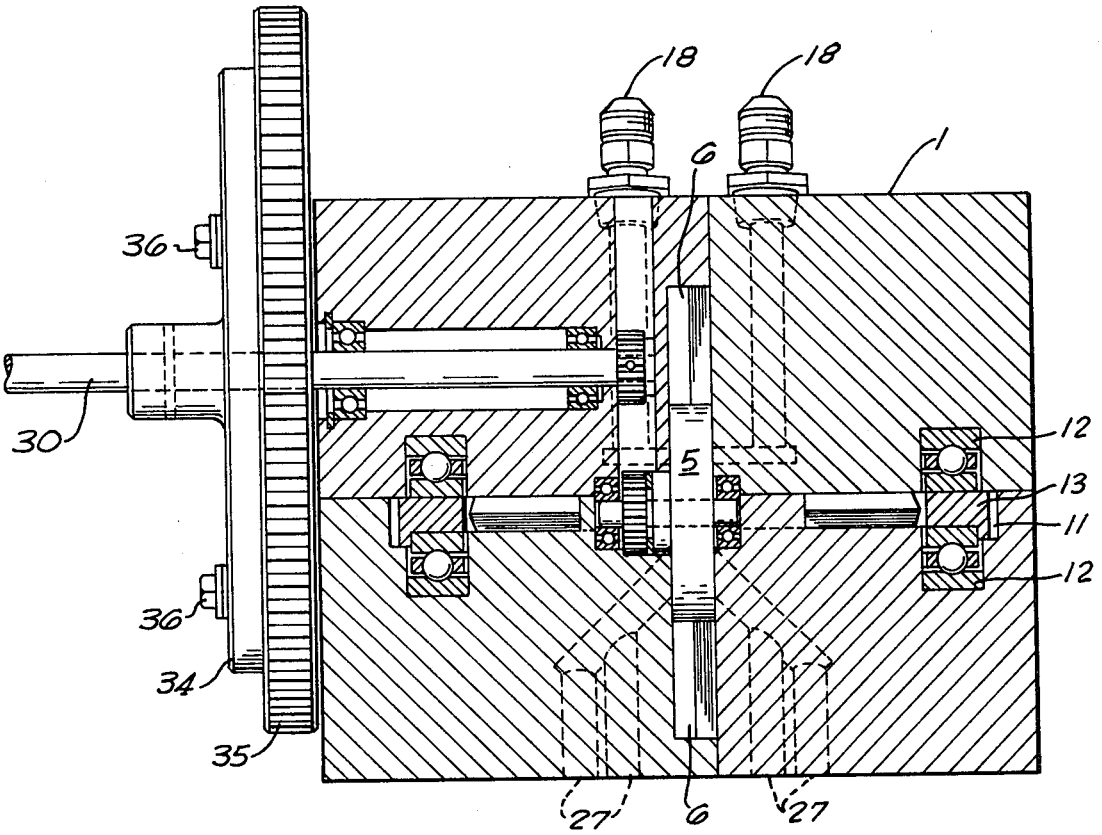
FIG. 4 is a side view of the invention, taken along line 4—4 in FIG. 2, again showing the interrelationship of the power and seal rotors. Also depicted here are the inlet and exhaust means, as well as the power transmission means.
Figure 6:
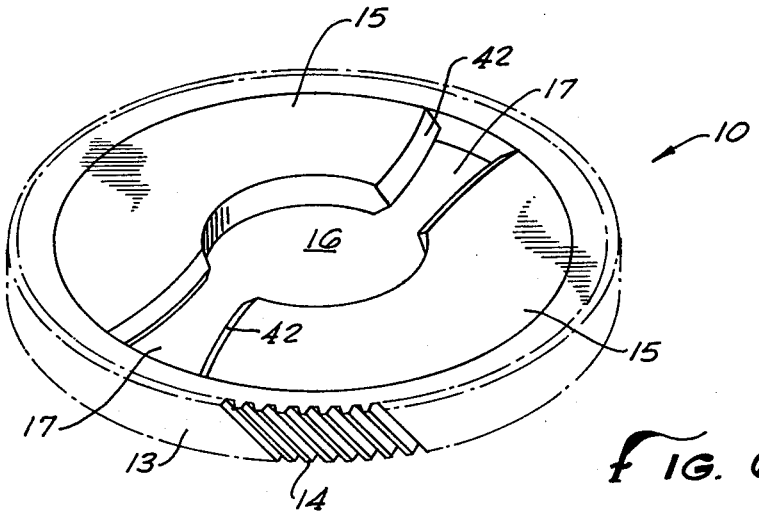
FIG. 6 is a perspective view of the seal rotor in isolation.
Figure 7:
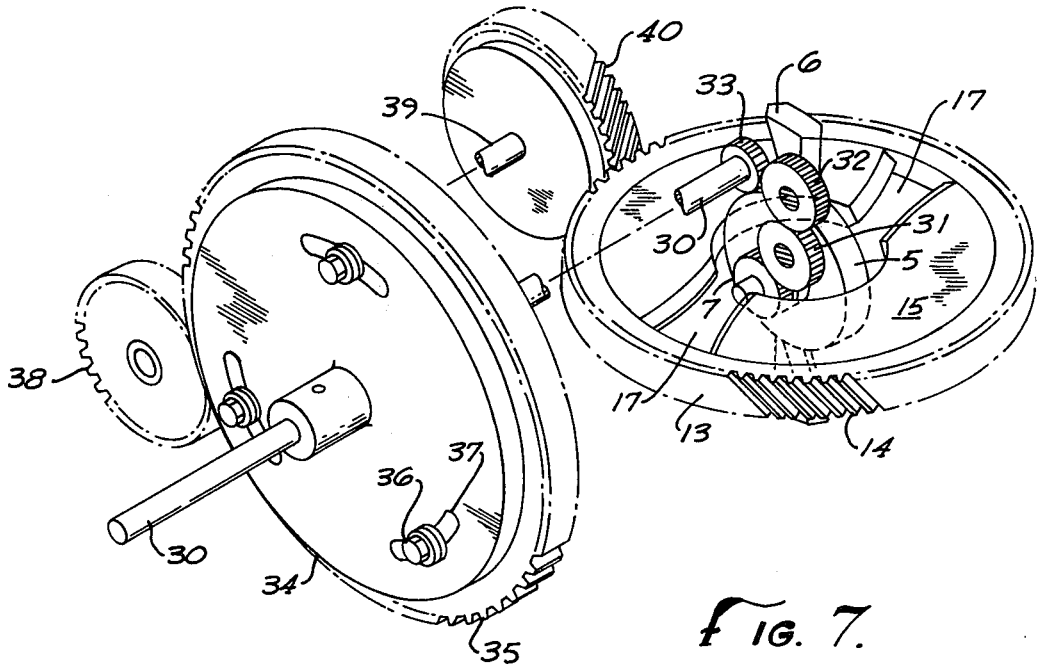
FIG. 7 is a perspective view showing the relationship of the power rotor and the seal rotor, as well as the power transmission and timing means, all in isolation.

Seal rotor 10 is disposed within second chamber 11, as best seen in FIGS. 3 and 4. Second chamber 11 is cylindrical except for its center portion 11(a), which contains the mounting means for the power rotor 3. Seal rotor 10 is freely rotatable within second chamber 11 upon thrust bearings 12. Both power rotor 3 and seal rotor 10 rotate about the same center point, but their planes of rotation are perpendicular as can best be seen in FIG. 4.

Seal rotor 10 consists of rim gear 13 having helical gear teeth 14 about its total periphery. Seal rotor vanes 15 are fixedly attached to the interior of rim gear 13 and extend inwardly towards the center of seal rotor 10. The seal rotor vanes 15 occupy nearly the entire interior space of seal rotor 10, leaving only a central, circular void space 16 and two outer spaces 17. Central circular void space 16 is sufficiently large to allow the rotor body 5 to rotate therein. Outer spaces 17 are sufficiently large to allow power rotor vanes 6 to pass freely therethrough. The outer spaces 17 defined by seal rotor vanes 15 are broadly hyperbolic in shape as the leading and trailing edges of seal rotor vanes 15 are convexly arcuate. This is to allow snug meshing during interdigitation of power rotor vanes 6 with seal rotor vanes 15 as power rotor 3 and seal rotor 10 are rotated.

Figure 8:
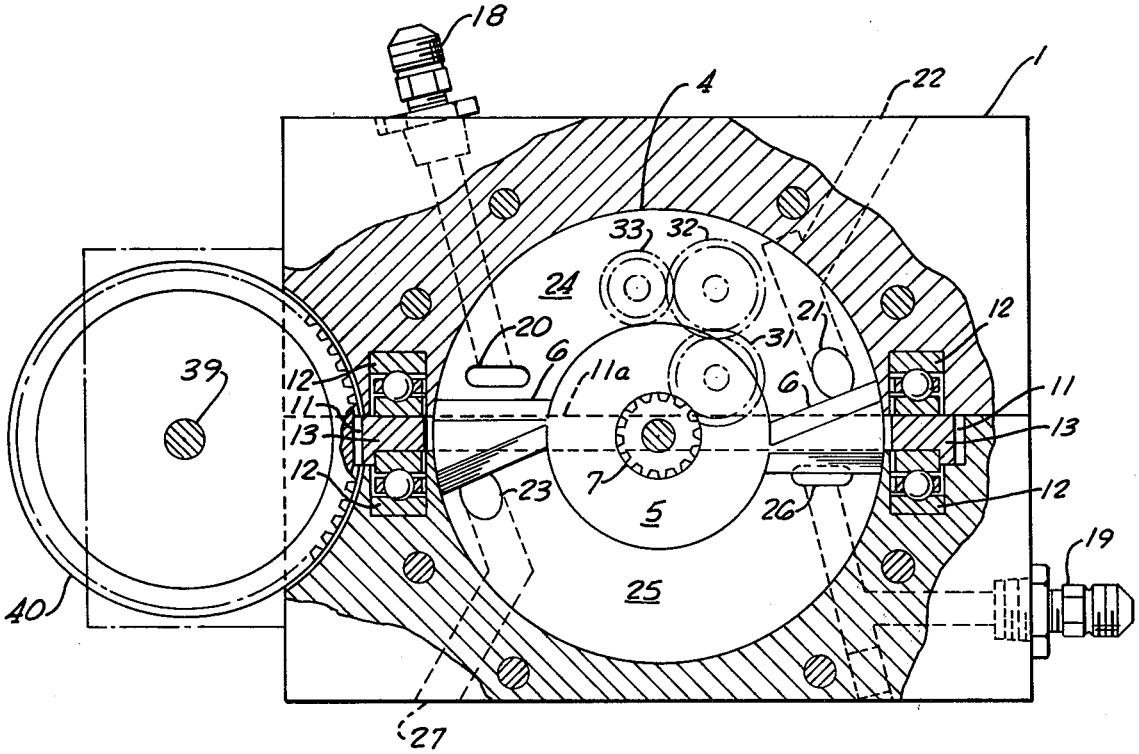
FIG. 8 is a side view of the invention, with a portion broken away to show the inlet and exhaust means in relation to the power and seal rotors.

Power rotor 3 is caused to rotate by introduction of fluid into first chamber 4. As best seen in FIG. 8, seal rotor 10 substantially divides chamber 4 into an upper half 24 and a lower half 25. Therefore, two sets of inlet and exhaust means are required. Inlet tubes 18 and 19 extend from the exterior of housing block 1 to chamber 4. The first pair of inlet ports 18 inject fluid into the upper chamber 24 in close proximity to rotor 10 at charge ports 20. Exhaust ports 21, positioned near seal rotor 10, and exhaust tubes 22 provide the means by which the fluid is removed from upper chamber 24. Second inlet tubes 19, second inlet ports 26, second exhaust ports 23 and second exhaust tubes 27 provide the same function for lower chamber 25. Notice that second inlet ports 26 and second exhaust ports 23 are positioned near seal rotor 10 in the same rotational order as first inlet ports 20 and first exhaust ports 21. The need for this arrangement will become apparent when the operation of the motor is discussed infra.

The rotational motion of power rotor 3 is transmitted to drive shaft 30 by a series of gears. Spur gear 7, which is fixably attached to power rotor 3 engages first idler gear 31 which in turn engages second idler gear 32, both idler gears being journaled within block 1 by conventional means. Second idler gear 32 engages drive shaft gear 33 which is fixably attached to drive shaft 30.

The rotation of drive shaft 30 is used to time the rotation of seal rotor 10. Timing flange 34 is fixably attached to drive shaft 30 by conventional means, such as a set screw. Timing flange 34 is attached to flywheel gear 35 by conventional bolt means 36 which extend through elongated holes 37 to engage flywheel gear 35. The elongated holes 37 allow the position of timing flange 34 to be adjusted relative to flywheel 35. Flywheel gear 35 engages transmission gear 38 which is connected by transmission shaft 39 to helical gear 40. Transmission shaft 39 is journaled and attached to block 1 by conventional means. Helical gear 40 engages rim gear 13 of seal rotor 10. By this system of gears, leading from spur gear 7 to idler gears 31 and 32, to drive shaft gear 33, to flywheel gear 35, to transmission gear 38 and, via transmission shaft 39, to helical gear 40, the rotational movement of the power rotor 3 is directly imparted to seal rotor 10. The position of seal rotor 10 relative to the position of power rotor 3 may be adjusted, to insure proper interdigitation of power rotor vanes 6 with outer spaces 17, by adjusting the position of timing flange 34 relative to flywheel gear 35.

In operation, fluid is injected into chamber 4 via inlet tubes 18 and 19. This causes power rotor 3 to rotate in a clockwise position, as shown in FIGS. 2 and 8. As the rotor vanes 6 pass through outer spaces 17 of seal rotor 10, each vane 6 interdigitating with a seal vane 15, seal rotor vanes 15 bisect chamber 4 into upper half 24 and lower half 25. This sealing of chamber 4 into upper and lower halves, each half containing one power rotor vane 6, reduces the presence of substantial backpressure against the leading edge of each vane 6 as it rotates through a half revolution. As chamber 4 is sized to eliminate, as much as possible, all free space about power rotor vanes 6, rotor vanes 6 are positively displaced by the incoming fluid. As the power vanes 6 pass the exhaust ports 21 and 23, the fluid is allowed to escape. The vanes 6 again interdigitate with the seal vanes 15 to allow the vanes 6 to move from lower chamber 25 to upper chamber 24 and from upper chamber 24 to lower chamber 25, respectively. Once the vanes 6 have moved into the next chamber, seal vanes 15 again bisect chamber 4 into the respective upper and lower portions 24 and 25, and the cycle is repeated. This interdigitation, whereby power rotor vanes 6 are timed to pass through outer void spaces 17 formed between seal rotor vanes 15, is made to occur with substantial meshing of power rotor vanes 6 with seal rotor vanes 15 by properly adjusting the position of rotor vanes 6 to the position of seal vanes 15, and by designing and constructing the leading edge 42 of seal vanes 15 to be slightly arcuate to correspond to the position of the rotor vanes 6 as it passes through outer space 17. The trailing edge of each seal vane 15 is arcuate to correspond to the position of power vanes 6 when the power rotor 3 is rotated in the reverse, counterclockwise direction. The shape of the leading and trailing edges of successive seal vanes 15 causes outer spaces 17 to be broadly hyperbolic in shape. This shape allows for close meshing of power vanes 6 with seal vanes 15 thereby providing for more efficient reduction of fluid backpressure.

Thus, an improved rotary positive displacement mechanism has been disclosed. While embodiments and application for this invention have been shown and described, it would be apparent to those skilled in the art that many more modifications and embodiments are possible without departing from the inventive concepts herein described. It will be particularly noted that the device here disclosed can be designed and constructed to function as a pump as well as a motor. The invention, therefore, is not to be restricted except by the spirit of the appended claims.

What is claimed is:

1. A rotary positive displacement device having a housing: a first cylindrical chamber and a second cylindrical chamber in said housing, a first rotor and a second rotor rotatable within said first and second chambers, respectively, each said rotor being rotatable about the same center point, said first rotor rotating in a plane which is substantially perpendicular to the plane in which said second rotor rotates; a thrust bearing within said second chamber upon which said second rotor rotates; said first rotor comprising a rotor body having a plurality of vanes extending outwardly therefrom; said second rotor having a rim gear with a plurality of vanes extending inwardly therefrom, said second rotor vanes being designed and constructed to create a void space between them, said void space comprising a center circular space and a plurality of outer spaces, said center space being of sufficient diameter to allow said first rotor body to rotate therein; and said outer spaces being of sufficient size to allow said first rotor vanes to pass therethrough; said outer spaces being broadly hyperbolic in ahape; each said vane having a leading and trailing edge, and each said edge being arcuate in shape and having a knife-like configuration such that there is substantial continuous meshing between corresponding said first and said second rotor vanes during interdigitation when said rotors are rotated in either direction to reduce fluid backpressure.

2. The device of claim 1 wherein said leading and trailing edges are beveled to a center knife-edge to allow for meshing of the vanes during rotation in either direction.

3. The device of claim 2 wherein said first rotor vanes are each substantially triangular in shape, attached at the apex of said triangle to said rotor body.

4. The device of claim 3 wherein said first cylindrical chamber is sized and shaped such that there is substantial sealing between said first rotor vanes and cylindrical chamber during rotation of said rotor vanes therein.

5. The device of claim 4 wherein timing means for synchronizing the rotation of said rotors to insure proper meshing is attached to the device.

6. The device of claim 5 wherein said timing means comprises a first gear which engages said second rotor, coupling means for communicating rotational movement of said first gear to a second gear; coupling means for communicating rotational movement of said second gear to said first rotor; and adjustment means attached to said second gear for adjusting the position of said second gear relative to said first rotor.

* * * * *